US005719608A

United States Patent [19]

Sabonis et al.

[11] Patent Number: 5,719,608

[45] Date of Patent: Feb. 17, 1998

[54] CONSTANT FLOW INK DELIVERY SYSTEM

[75] Inventors: Charles J. Sabonis, San Ramon; Howard Siu, South San Gabriel, both of Calif.

[73] Assignee: CalComp Inc., Anaheim, Calif.

[21] Appl. No.: 434,215

[22] Filed: May 4, 1995

[51] Int. Cl.[6] ..... B41J 2/17

[52] U.S. Cl. ..... 347/85; 347/94

[58] Field of Search ..... 347/84, 85, 94; 137/247.29, 247.11, 247.31; 181/206

[56] References Cited

U.S. PATENT DOCUMENTS 4,359,134 11/1982 Jackson ..... 181/206 X
4,422,086 12/1983 Miura et al. ..... 347/85

*Primary Examiner*—John E. Barlow, Jr.
*Attorney, Agent, or Firm*—Frederic P. Smith; William F. Porter, Jr.

[57] ABSTRACT

An improved ink delivery system for an ink jet printer having a print carriage that traverses across a print medium comprising an ink source, a print head, and a coupler for coupling the ink source to the print head, the coupler including a pair of flexible tubes for carrying the ink and a Y-coupler for coupling to the pair of flexible tubes and the ink source, the Y-coupler causing the pair of flexible tubes to initially diverge. A check valve is provided to prevent back siphoning.

12 Claims, 7 Drawing Sheets

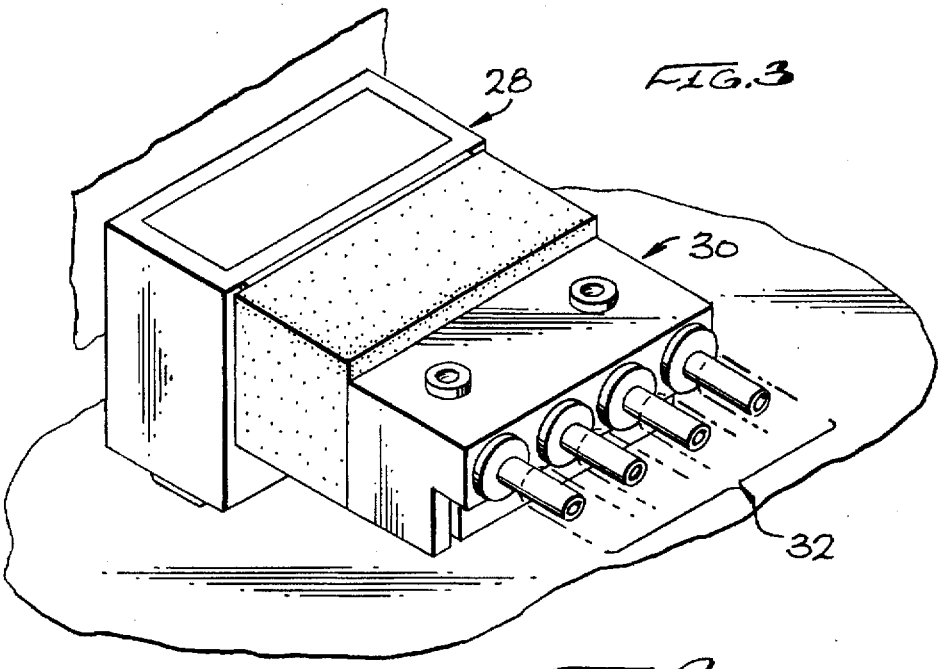
FIG. 3
FIG. 4
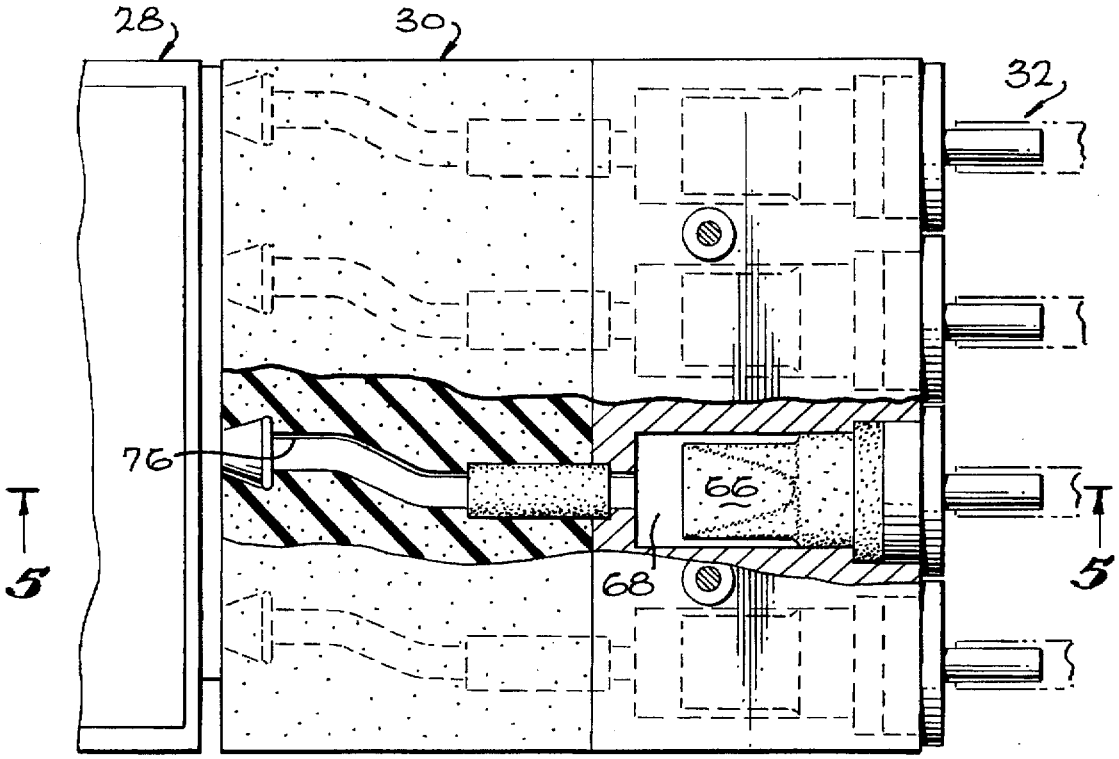

FIG. 9
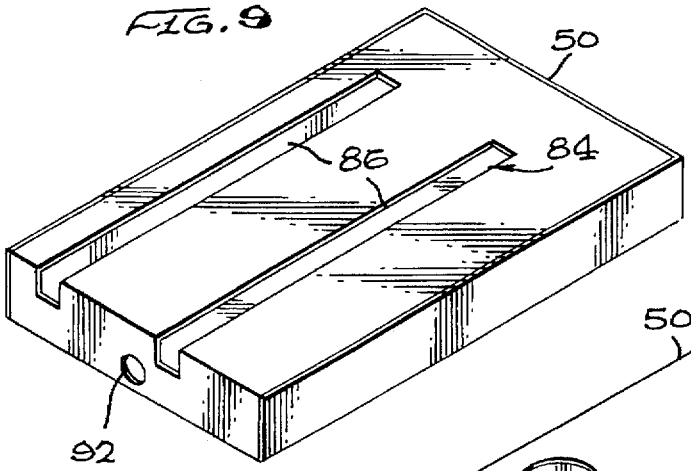
FIG. 10
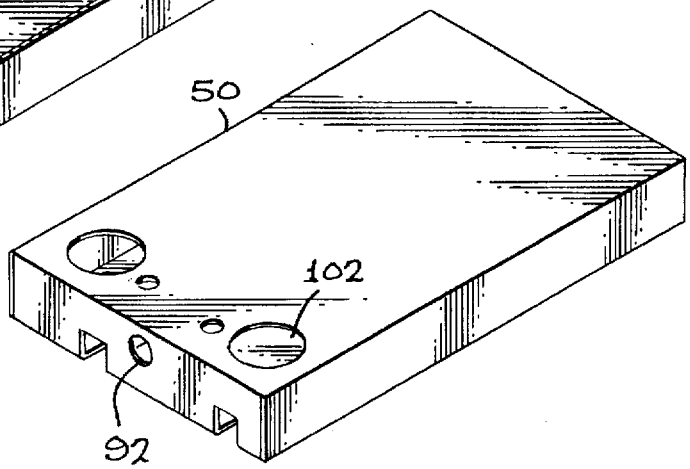
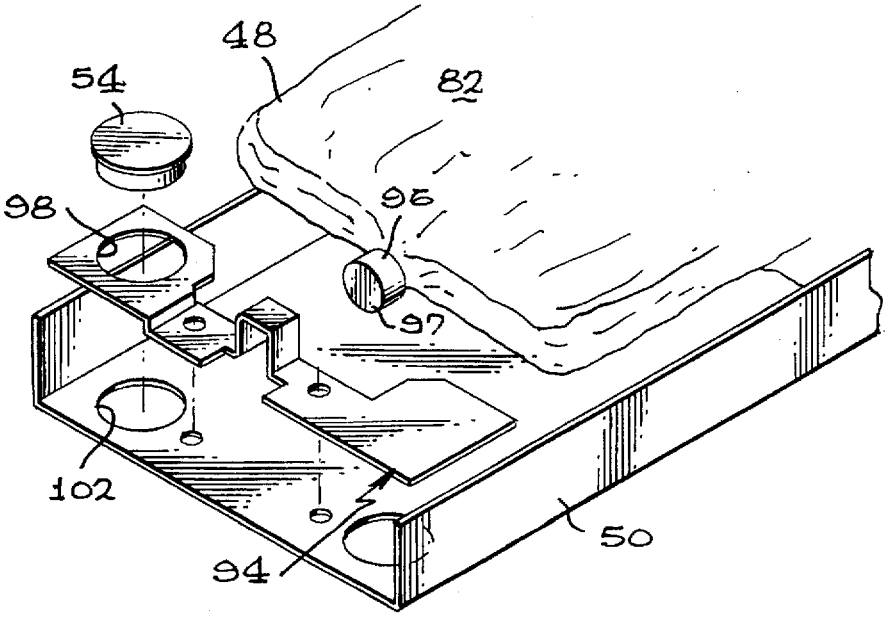
FIG. 11

FIG. 12
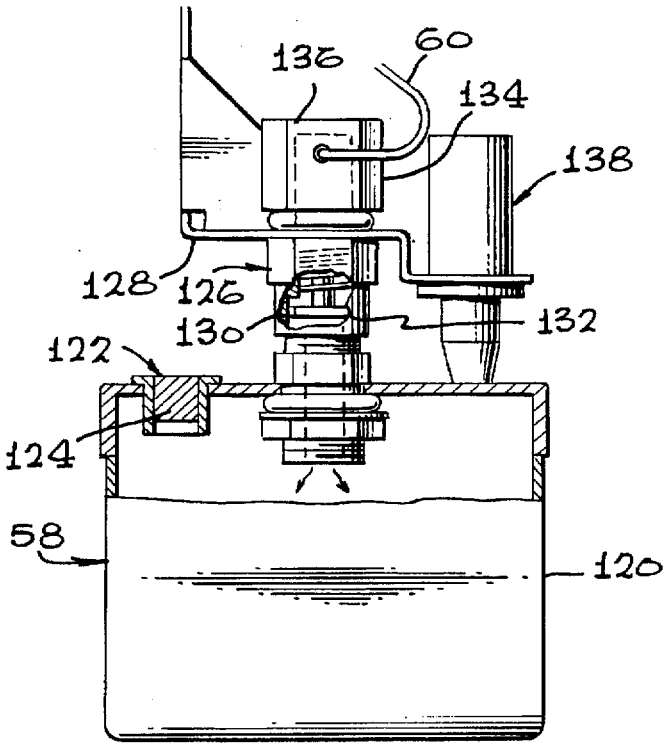
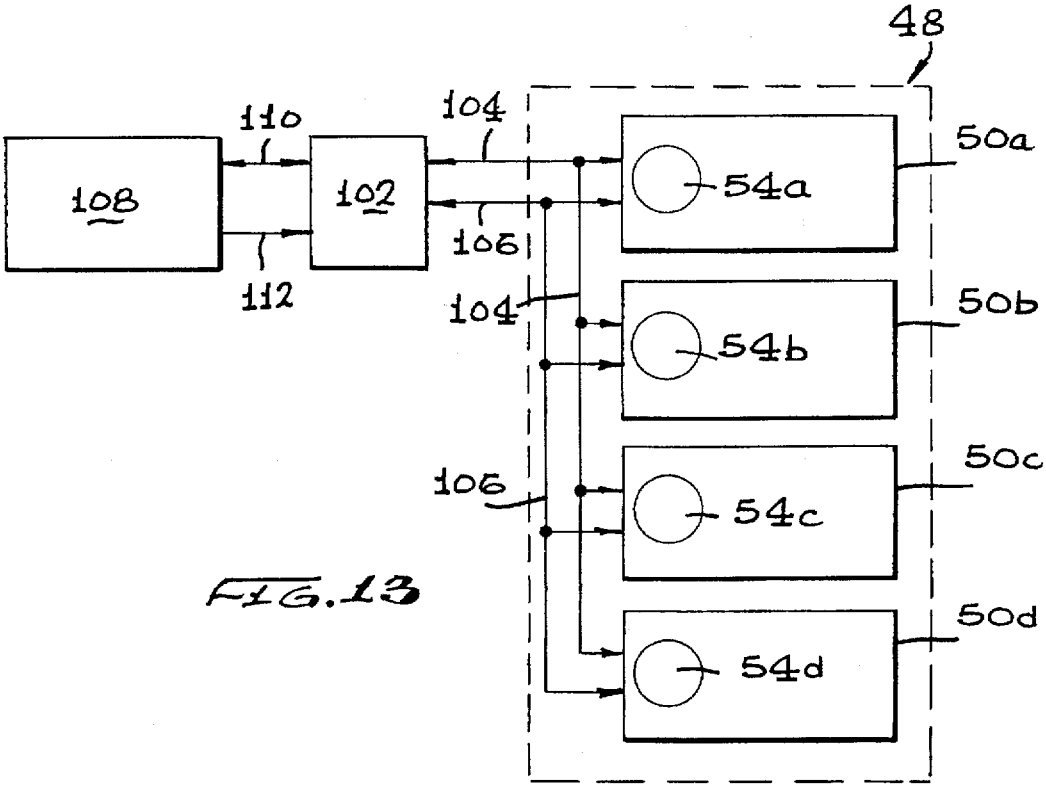
FIG. 13

CONSTANT FLOW INK DELIVERY SYSTEM

BACKGROUND OF THE INVENTION

1. Field of the Invention

This invention relates to the field of ink jet printers and, in particular, to an improved ink delivery system for large format ink jet printers.

2. Description of Related Art

With the increased use of computer hardware and software to generate information in visible multidimensional form such as graphs and graphics, as contrasted to mere numerical listings, there has come a concomitant increased use of printers and plotters to fix such information on a tangible media. Printers and plotters capable of handling the output of such computer systems have been developed and are continually being upgraded to ensure that fast and accurate plots are being produced. With the increase in plotter speed, use of multicolor plots, use of ink jet print heads, etc., however, there has arisen inevitable problems in ink supply, such as runout, uneven ink trace due to momentary ink loss or large bubbles in the ink, improper color matching and even mixup, etc. Thus, it is imperative that there exist a quick recognition of the above problems and proper preventative measures be taken to obviate the problems or to cause a rapid system shut down. This is particularly important in the area of ink supply since a failure of a proper ink supply can result in an uneven or incomplete trace or even a total loss of information presumed to be recorded.

One particular problem in the provision of constant flow of ink has arisen in nonimpact printers where the ink jet print head is reciprocally moved across a large format printer at high speeds to scan across a recording sheet. In the normal ink delivery system, a single ink delivery tube was used to deliver ink to an on demand ink jet print head. One problem associated with this design was that the tubing moving with the print head as the print head moved transversely across the print medium became a peristaltic pump, with ink being pushed or pulled depending on the scanning direction. While on letter size printers, the tubing was sufficiently short so that the turbulence generated was not significant enough to disturb the basic flow, with larger sized printers the pumping was significant and would cause flooding or starving of ink in the print head. This constant flow problem was only partially solved by dividing the tubing into two loops by use of a T-coupler or two ink reservoirs and later joining the two loops by use of a T-coupler or a valving arrangement in an attempt to cancel opposing pressure variations and to prevent pressure surges, such as shown in U.S. Pat. Nos. 4,527,175 and 4,422,086 and IBM Technical Disclosure Bulletin Vol. 21, Number 12, May 1979. Problems in even flow and pressure variation continued to exist along with back siphoning due to tubing imbalance Thus, it is a primary object of the present invention to provide an improved ink delivery system.

It is another object of the present invention to provide an improved ink delivery system which provides a constant flow of ink.

It is a further object of the present invention to provide an improved ink delivery system which minimizes pressure variations in the flow of ink.

It is still another object of the present invention to provide an improved ink delivery system which suppresses back siphoning due to tubing imbalance.

SUMMARY OF THE INVENTION

An improved ink delivery system for an ink jet printer having a print carriage that traverses across a print medium is provided comprising an ink source, a print head, and a coupler for coupling the ink source to the print head, the coupler including a pair of flexible tubes for carrying the ink and a Y-coupler for coupling to the pair of flexible tubes and the ink source, the Y-coupler causing the pair of flexible tubes to initially diverge. A check valve is provided to prevent back siphoning.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 3 is a perspective view of a manifold and print head used in conjunction with the present invention.

FIG. 4 is a top plan view, partially broken away, of the manifold and print head of FIG. 3.

FIGS. 9 and 10 illustrate an ink source container used in conjunction with the present invention.

FIG. 11 is a broken-away exploded view of the container of FIGS. 9 and 10 illustrating the placement within the ink source container of the ink source and an encryption device used in conjunction with the present invention.

FIG. 12 illustrates a reservoir and valve system used in conjunction with the present invention.

FIG. 13 is a system block diagram of the information encryption device used in conjunction with the present invention.

DESCRIPTION OF THE PREFERRED EMBODIMENT

Figure 1:
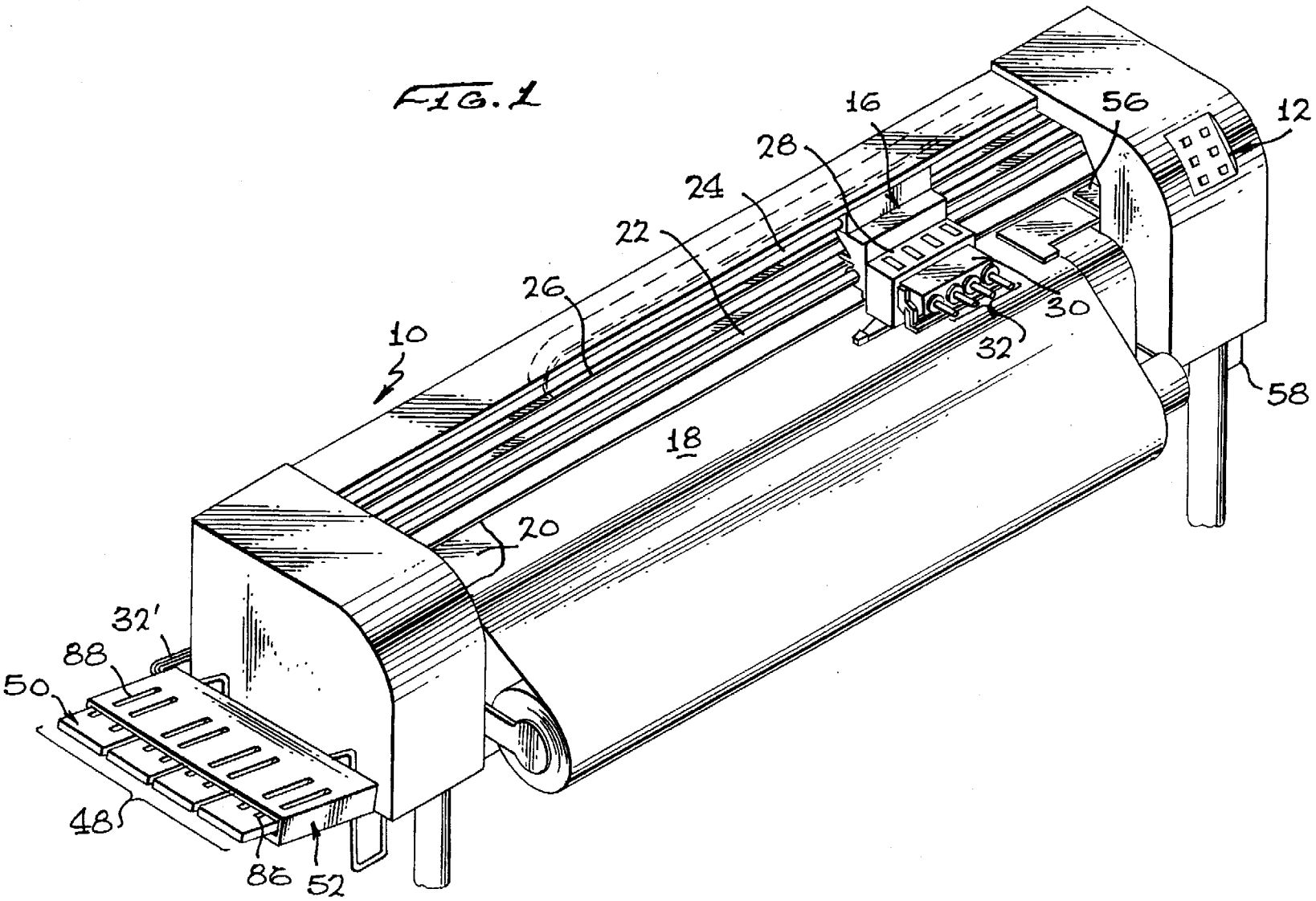
FIG. 1 is a perspective view of a plotter illustrating the environment of use of the present invention along with various elements thereof.
Figure 2:
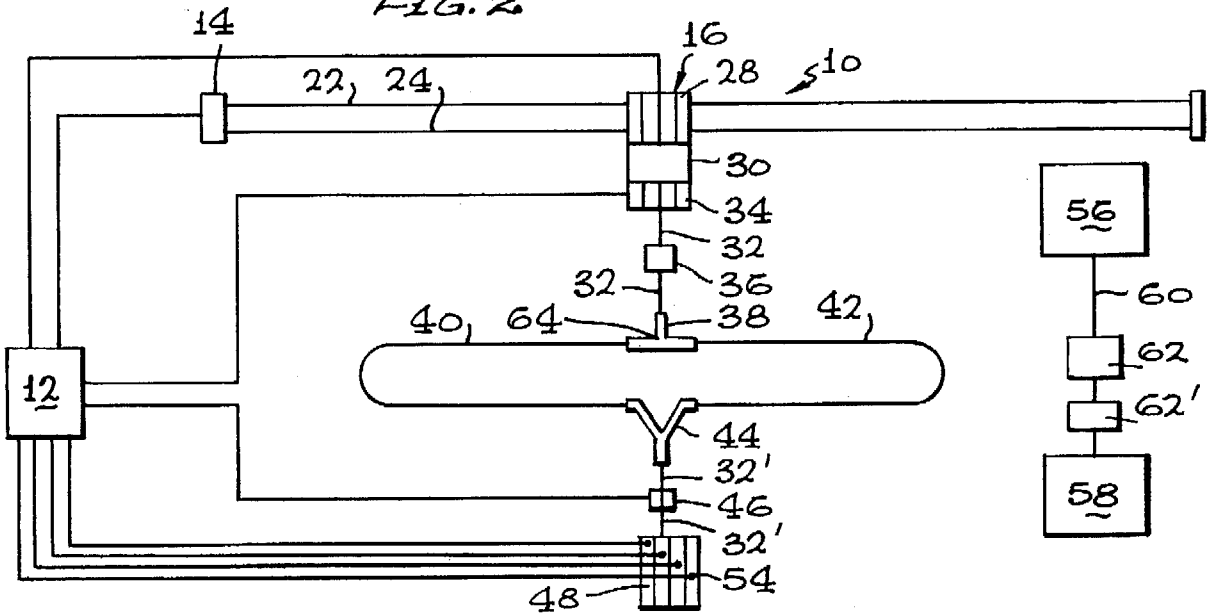
FIG. 2 is a simplified diagrammatic view of various elements used in the present invention.

Referring now to FIGS. 1 and 2, the structure and operation of the present invention is illustrated. A plotter or printer 10 is shown under command of a controller 12. The controller 12 is coupled to a drive 14 which drives a print carriage 16 transversely across a print medium 18 supported by a platen 20 in the plotter 10. The carriage 16 is supported by support rods 22,24 and is driven by belt 26. The carriage 16 supports a plurality of print heads 28 of the ink jet variety and a manifold 30 coupled to the print heads 28. The manifold 30 is coupled to flexible tubes 32, only one of which is shown in FIG. 2 for simplicity, and has sensors 34 therein to detect voids in the ink flow. The flexible tubes 32 are coupled to check valves 36 and T-couplers 38 which divide each tube 32 into two tubes 40,42 to even out the ink flow and which are afterwards merged by Y-couplers 44 and coupled by flexible tubes 32' to sensors 46 and ink sources 48 enclosed in differentiating structures 50 and supported by ink source holder 52. The controller 12 is also coupled to the print heads 28, sensors 34 and encryption devices 54 coupled to the ink sources 48 for enabling and disenabling the carriage 16 upon certain operational circumstances, as explained further hereinafter. The plotter 10 also includes a service station 56 where the print heads 28 are moved by the carriage 16 under command of the controller 12 to purge the ink heads 28. The service station 56 is coupled to a reservoir 58 by a drain line 60 and valves 62,62' for collecting ink purged from the print heads 28.

As stated previously, the problem of peristaltic pumping causing flooding or starving of ink in the print head was only partially solved by dividing the tubing into two loops by use of a T-coupler or two ink reservoirs and later joining the two loops by use of a T-coupler or a valving arrangement in an attempt to cancel opposing pressure variations and to prevent pressure surges. To solve this problem, ink source 48 is coupled by tube 32' to Y-coupler 44 via sensor 46 at which point tube 32' divides into tubes 40,42 of equal length and diameter which are later joined by T-coupler 38 to provide a balanced system in which the flow of ink in the tube 32' is equal to the sum of the flow of ink in the tubes 40,42, T-coupler 38 being coupled by tube 32 to manifold 30 via check valve 36. As is shown in FIG. 2, Y-coupler 44 has been provided at the division point of tube 32' instead of the prior art T-coupler, the Y-coupler generally subtending a 60° angle. It has been found that by providing a Y-coupler 44 at the division point of tube 32', instead of a T-coupler, any standing pressure waves are effectively stopped from forming in the loop created by the tubes 40,42, the T-coupler 38 and the Y-coupler 44 and that the independent pressure waves generated in the tubes 40,42 substantially cancel one another when combining at the junction point 64 of the T-coupler 38 where the two tubes become one tube, and thus at T-coupler 38 the net effect of the peristaltic pumping is negligible. In addition, check valve 36 has been provided to suppress any back siphoning due to tubing imbalance, thus further preventing any ink flow problems to the print head 28, and to hold ink from backing out of the tubing when the ink source 48 is removed for replacement. As described hereinafter and shown in FIG. 8, sensor 46 may be positioned in the ink delivery system at the beginning of and encircling tube 32'.

As is shown in FIGS. 1–5, a manifold 30 is coupled to the print heads 28 and the tubes 32 and is supported and moved by the carriage 16 under command of the controller 12. While a manifold customarily refers to a multiported mixing chamber, in the present case the manifold 30 has individual separate chambers coupled to individual separate heads and joined in or formed from a unitary block, each chamber being identically designed for purposes of this invention and also referred to as manifold 30. The manifold 30 acts to couple the flow of ink in the tubes 32 to the print heads 28 and to ensure that a steady, reliable and uninterrupted flow of ink is provided to the print medium 18 by preventing small voids in the ink from coalescing into large voids. To this effect, the ink in the tube 32 enters the manifold 30 and is projected by nozzle 66 into chamber 68. Chamber 68 includes an upper portion 70 and a lower portion 72 and has an upwardly-stepped portion 74 therein in the path of the flow of ink for causing small voids in the ink to rise and individually exit from the print head 28. Thus any small voids in the ink flow which enter the lower portion 72 of the chamber 68 are caused by the turbulence therein to rise into the upper portion 70 and flow into the tube 76 before they have the chance to coalesce. The tube 76 also slopes downward so that voids will continue to flow along the top portion 78 thereof and not coalesce before entering the print head 28.

In order to accommodate the requirements of the system that the manifold 30 not only prevent the coalescence of voids but also prevent the introduction of voids into the system and allow for the differing inlet and outlet pitch spacings needed to couple the ink supply to the print head, the manifold 30 consists of a valve body **30*a* which couples to the tube 32 and includes the chamber 68 and a coupling portion 30*b* which includes the tube 76. The coupling portion 30*b* is bonded to the valve body 30*a*, generally made of plastic, and has inserted therein a tube 75 which is bonded or integral with the valve body 30*a* and forms a portion or extension of the tube 76. The coupling portion 30*b* is attached to the head 28, generally made of plastic, and has inserted therein a fitting 77 which is bonded or integral with the head 28 and also forms a portion or extension of the tube 76. In order to be able to accommodate the insertion of the tube 75 and the fitting 77 therein, to be able to be molded to the differing pitches of the tube 76 to couple the head 28 to the tube 32, and to absorb the stresses of the moving head 28 carrying the tube 32 with it, the coupling portion 30*b* is molded of an elastomeric material, such as a rubber having a 25 Shore A durometer. The coupling portion 30*b*, because of its flexibility, stretches to allow the tooling for the tube 76 and its juncture portions with the tube 75 and the fitting 77 to be removed from it and the tube 75 and the fitting 77 to be inserted into it, forming an airtight and integral compression bond, and flexes when the head 28 accelerates pulling the tube 32 along with it. To further assure an airtight bond, an anaerobic cement such as Locktite can be used to bond the valve body 30*a* to the coupling portion 30*b***.

Figure 8:
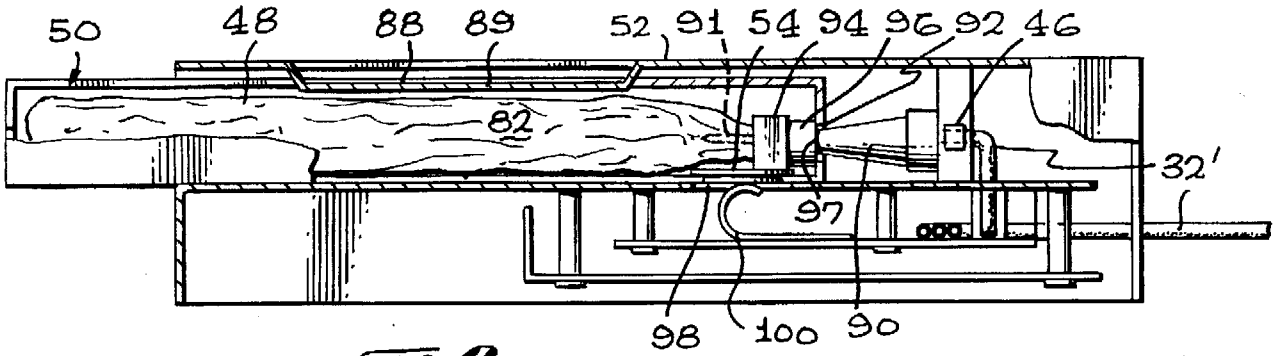
FIG. 8 is a cross-sectional view taken along line 8—8 of FIG. 7.
Figures 5, 6:
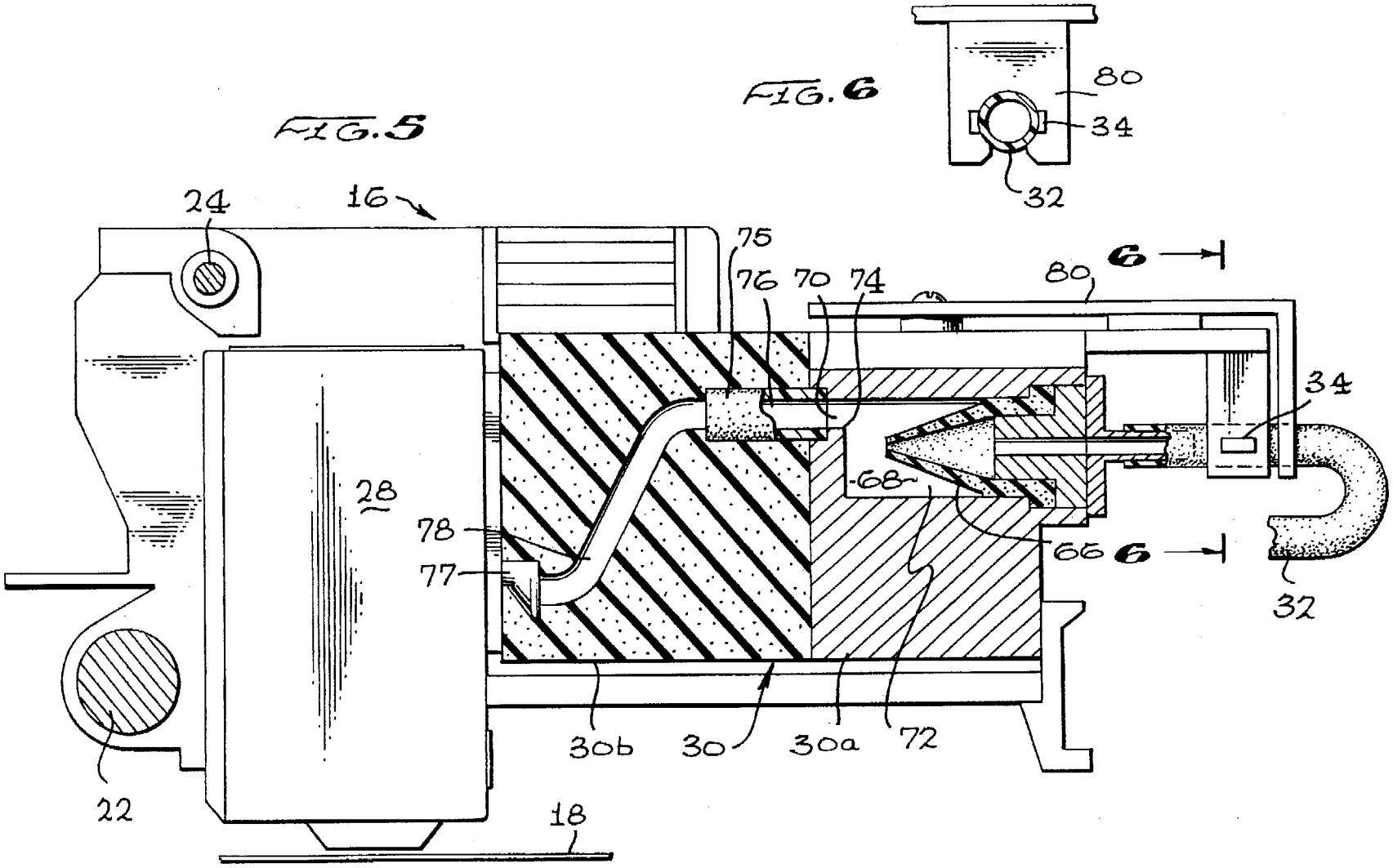
FIG. 5 is a cross-sectional view of the manifold and print head taken along line 5—5 of FIG. 4.
FIG. 6 is a cross-sectional view of a sensor used in conjunction with the present invention taken along line 6—6 of FIG. 5.
Figure 7:
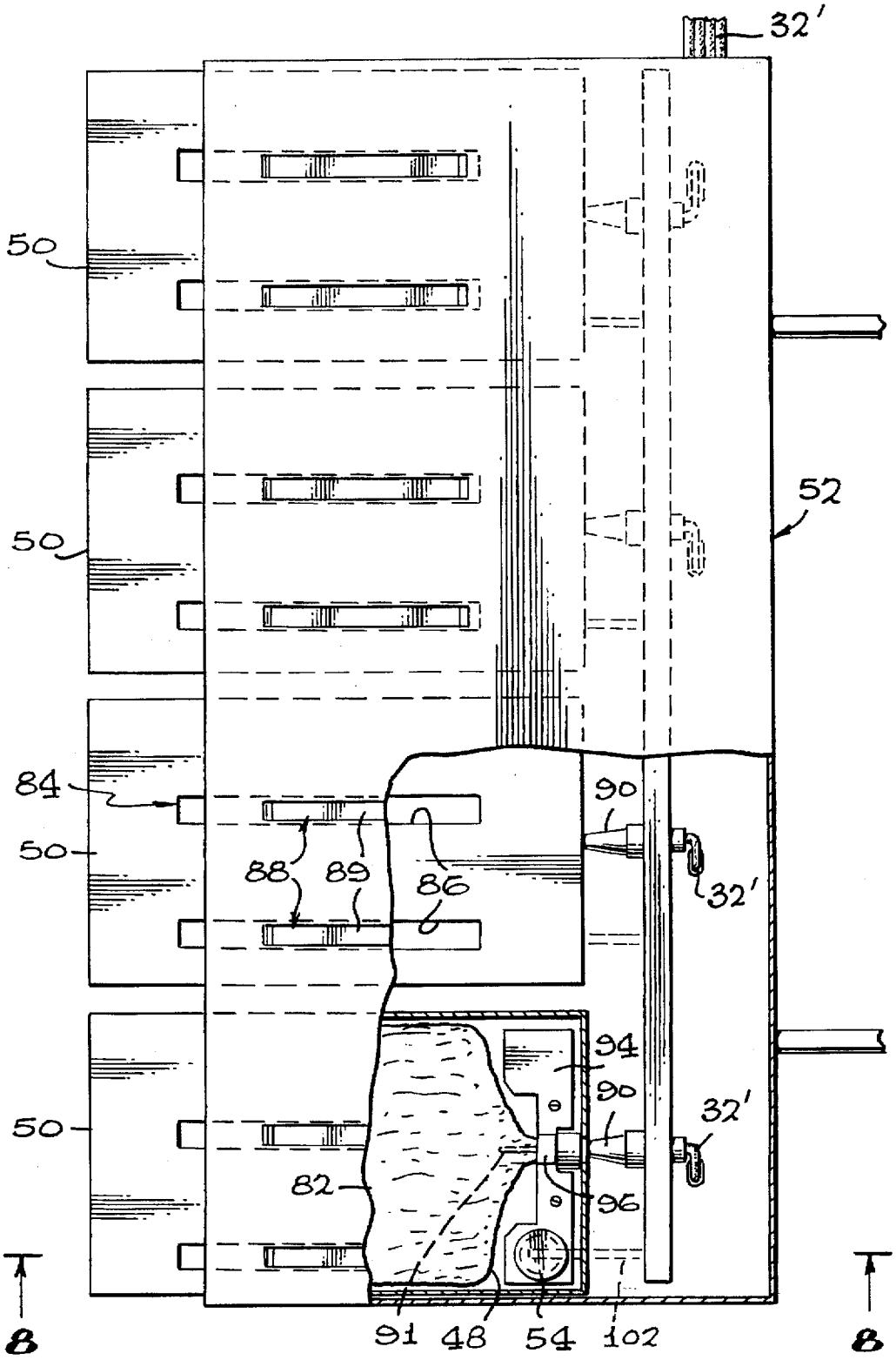
FIG. 7 is a top plan view, partially broken away, of an ink source, an ink source container and an ink source holder used in conjunction with the present invention.

The manifold 30 also has sensor 34 therein, generally an optical sensor, supported by arm 80. As shown in FIGS. 1, 5 and 6, sensor 34 is coupled to tube 32, which is generally transparent, and controller 12 and acts to detect large voids in the ink flow and to send a signal to controller 12 upon such detection. Similarly, sensor 46 is coupled to tube 32' and controller 12, as shown in FIGS. 1 and 8, and acts to detect large voids in the ink flow and to send a signal to controller 12 upon such detection. In operation, if sensor 46 detects a void in the ink flow, the controller 12 causes a message to be displayed on a control panel to check the ink source 48. If sensor 34 detects a void in the ink flow, the carriage 16 is directed by the controller 12 to the service station 56 where a purge/prime is conducted on the print head 28 and then the system resumes normal operation. Finally, the controller 12 is programmed to stop the carriage 16 and display an out of ink condition upon simultaneous detection of voids at both sensors 34 and 46 as this condition generally indicates a total lack of ink flow due to a cartridge runout rather than an occasional air bubble in the ink supply. Sensors 34 and 46 could also be capacitance or doppler type sensors which could detect voids in the ink supply without the tubes having to be transparent.

As is shown in FIGS. 1, 2 and 12, the plotter 10 has a service station 56 to which the carriage 16 and the printing heads 28 are directed by the controller 12 when the printing heads need to be primed and/or purged at, for example, replacement of an ink source 48, start-up after a long delay or clearing out of voids in the ink supply. In standard plotters, this service station generally consists of a vacuum pump to draw ink from the heads and one or more felt pads to absorb the withdrawn ink. In the present configuration where ink sources 48 generally contain 175 ml of fluid for each of four colors and there is about 20 percent waste, felt pads are insufficient and provision has to be made for upwards of 120 ml of fluid. To this end, a separate reservoir 58 is provided coupled to the service station by a drain line 60. One or more shut-off valves 62,62' are provided so that the reservoir 58 can be connected and disconnected from the drain line 60 without leakage from the drain line 60 and without leakage from the reservoir 58 itself. As the ink source 48 contains a selected volume of ink, the reservoir 58 has a sufficient volume to contain all the ink purged during the depletion of the ink source 48.

Referring now to FIG. 12, the reservoir 58 has a container 120 having a vent hole 122 with a porous plug 124 therein which allows air in the container 120 to exit when the ink is accumulated therein but will not allow ink to escape from the container 120. The container 120 has a coupling 126 connected thereto which enables the container 120 to be supported by insertion through a flange 128. The coupling 126 has a lower portion 130 which contains a valve 132 therein and an upper portion 134 which contains a valve 136 therein. When the upper and lower portions 130,134 are coupled through the flange 128, valves 132,136 are automatically opened to allow ink to collect in the container 120. Conversely, when the upper and lower portions 130,134 are decoupled, valves 132,136 are automatically closed to prevent ink from exiting from both the tube 60 and the reservoir 58. A plunger type sensor 138 is also coupled to the flange 128 and is depressed by the container 120. When the reservoir 58 is removed, the sensor 138 is no longer depressed and send a signal to the controller 12 which commands the printer 10 to stop. When the reservoir 58 is replaced and the sensor is again depressed, the controller 12 reactivates the printer 10 and operation is resumed. While a plunger type sensor has been shown, other types of recognition sensors, such as optical, could be used. In addition, if minor leakage can be tolerated, valve 132 could be dispensed with.

Referring now to FIGS. 1, 2 and 7–11, the ink source 48 consists of a sealed, airtight, flexible bag 82 which is enclosed in a container 50. As shown in the Figures, four ink sources 48 are provided enclosed in four containers 50 to accommodate the colors black, cyan, magenta and yellow used in multicolor plotters. Each of the containers 50 has a differentiating structure 84 thereon, shown as a pair of differently located and/or spaced slots 86, keyed to a particular color. The ink source holder 52 has a corresponding plurality of differentiating structures 88 therein, such as depressed bars 89, for accepting and positioning a particular one of the plurality of containers 50 and ink sources 48 for coupling to a corresponding particular one of the plurality of print heads 28. In addition to differentiating the containers 50 and the ink sources 48, the slots 86 afford a visual inspection of the amount of ink remaining in the flexible bag 82 in the event the printer 10 is to be left unattended for a long period of time. Furthermore, the position of the depressed bars 89 not only functions to totally prevent the insertion of an incorrect container 50 but also acts as a safety feature to prevent or inhibit the insertion of foreign objects, such as fingers, which could be damaged or punctured by the hollow needles 91 discussed below or which could damage the needles 91 themselves.

Positioned within the ink source holder 52 are a plurality of holders 90 for hollow needles 91 which puncture each ink source 48 and properly couple the ink therein via tube 32' to a corresponding print head 28. The containers 50 have apertures 92 through which the holders 90 can be inserted and hold-down mechanisms 94 for securing the necks 96 of the bags 82 so that the septums 97 covering the necks 96 can be punctured by the needles 91. While a plurality of print heads 28 are shown corresponding to the plurality of ink sources 48, only one print head 28 could be used and the tubes 32' could be switched, manually or otherwise, to provide various colors to the single print head 28, with the print head 28 being purged each time a tube 32' is switched.

The flexible bag 82 is also designed to contain, in addition to a selected volume of ink, a selected volume of gas, such as air to provide both an air space and a dead space. The dead space is provided so that there is pressure relief in the event of temperature and atmospheric changes which would cause expansion of the ink and air and thus cause an undesired pressure to force the ink into the system when it is not called for. The air space is provided so that when the bag 82 is empty of ink the tube 32' can also be drained of ink by the introduction of air from the air space into the tube 32' and to prevent negative pressure therein. For a bag 82 containing 175–180 ml of ink and allowing for a temperature variation of 38°–44° C. and an atmospheric pressure variation of 74–80 inches of mercury, the dead space needed would be 18–20 ml. The air space needed depends, for example, on the length of lines used and the inner diameter of the lines and is of the order of 8–10 ml. The dead space thus generally occupies 9–9.5% of the bag 82 and the air space generally occupies 4–5% of the bag 82. For a controlled environment, the dead space could even be eliminated. The support 52 is also designed to hold the container 48 at an acute angle, generally 10°, in order to cover the hollow needle 91, at least up to the portion where the ink flows into it, so that the bag 82 can be completely emptied and to prevent air from prematurely entering the tube 32'.

Referring now to FIGS. 1, 2, 7, 8, 11 and 13, information encryption devices 54, such as so-called smart chips made by Dallas Semiconductor, DS1982, are shown coupled to the ink sources 48 and the controller 12 for enabling and disenabling the carriage 16. The, encryption devices 54 are positioned in apertures 98 of the containers 50 and are electrically coupled to the controller 12 by contact with springs 100 through apertures 98 in the containers 50. The encryption devices 54 may have coded therein, and provide to the controller 12, for example, information as to the source and color of the ink in the bag 82 and the amount of ink originally in the bag 82. The presence or absence of the container 50 can also be sensed by the controller 12 from the presence or absence of an encryption device 54. The controller 12 can then act upon this information to enable and disenable the carriage 16. Since the controller 12 is also coupled to and controls the print heads 28, the controller 12 can determine the amount of ink used from the corresponding ink source 48 by counting the number of dots generated by the print head 28 for a particular color and disenable the carriage 16 when the ink source 48 is substantially used up. In addition, the encryption devices 54 can also be used to store on a real time basis data concerning the ink supply, such as the amount of ink remaining in the bag 82.

Referring now to FIG. 13, a system block diagram of the present invention is shown. The information encryption devices **54*a–d* are mounted on the individual containers 50a–*d* within the ink source 50. The devices 54*a–d* are serially connected to interface 102 via signal line 104 and program line 106 and the interface 102 is connected to a microcomputer 108 via lines 110,112. Both the interface 102 and the microprocessor 108 are located within the controller 12. Line 110 is a bidirectional data line and carries data between the microcomputer 108 and the devices 54***a–d*. Line 112 is a unidirectional programming line and is used to carry information which is to be written into the EPROM section of devices 54*a–d* by the microprocessor 108. The interface 102 contains circuitry to apply a 12 volt level to signal line 104 when a high program signal is generated by the microprocessor 108 to indicate a data writing mode and also isolates the microprocessor 108 from the 12 volt level. When the program signal is not high, interface 102 simply allows data to pass in both directions. The devices 54*a–d* each contain a unique identification number to allow them to be addressed uniquely and to be connected to a single serial communications bus, the devices 54*a–d* also containing circuitry which allows them to communicate serially with the microprocessor 108. The microprocessor 108 provides timing reference pulses to synchronize the communications.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

We claim:

1. An ink delivery system for a printer having a print carriage that traverses across a print medium comprising:

an ink source;

a print head; and coupling means for coupling said ink source to said print head, said coupling means including a pair of flexible tubes for carrying said ink and a Y-coupler for coupling to said pair of tubes and said ink source, said Y-coupler causing said pair of tubes to initially diverge and preventing standing pressure waves from forming in said flexible tubes.

2. The ink delivery system of claim 1 wherein said pair of tubes converge at said print head and said coupling means includes joining means for joining said converging tubes and coupling said tubes to said print head.

3. The ink delivery system of claim 2 wherein said converged tubes are coupled to a check valve before being coupled to said print head.

4. The ink delivery system of claim 1 wherein said Y-coupler causes said tubes to diverge at a 60° angle.

5. The ink delivery system of claim 2 wherein said joining means comprises a T-coupler, whereby independent pressure waves generated in said flexible tubes are substantially canceled.

6. An ink delivery system for a printer having a print carriage that traverses across a print medium comprising:

an ink source;

a print head; and coupling means for coupling said ink source to said print head, said coupling means including a pair of flexible tubes for carrying said ink and first joining means for joining said flexible tubes at one end thereof at a selected angle less than 180° to prevent standing pressure waves from forming in said flexible tubes.

7. The ink delivery system of claim 6 wherein said first joining means comprises a Y-coupler for joining said flexible tubes, said Y-coupler causing said pair of flexible tubes to initially diverge.

8. The ink delivery system of claim 6 wherein said selected angle is a 60° angle.

9. The ink delivery system of claim 6 wherein said first joining means joins said flexible tubes to said ink source.

10. The ink delivery system of claim 6 wherein said pair of flexible tubes converge at said print head and said coupling means includes second joining means for joining said converging tubes and coupling said tubes to said print head.

11. The ink delivery system of claim 10 wherein said converged tubes are coupled to a check valve before being coupled to said print head.

12. The ink delivery system of claim 10 wherein said second joining means comprises a T-coupler, whereby independent pressure waves generated in said flexible tubes are substantially canceled.

* * * * *